United States Patent [19]

Stumpp

[11] 4,348,998

[45] Sep. 14, 1982

[54] FUEL INJECTION PUMP

[75] Inventor: Gerhard Stumpp, Stuttgart, Fed. Rep. of Germany

[73] Assignee: Robert Bosch GmbH, Stuttgart, Fed. Rep. of Germany

[21] Appl. No.: 872,862

[22] Filed: Jan. 27, 1978

[30] Foreign Application Priority Data

Jan. 29, 1977 [DE] Fed. Rep. of Germany ..... 2703685

[51] Int. Cl.[3] ..... F02M 59/34

[52] U.S. Cl. ..... 123/447; 123/459; 123/503; 123/505; 123/506; 417/279; 417/282

[58] Field of Search ..... 123/139 BG, 139 BD, 123/139 AW, 139 AS, 119 R, 139 AF, 139 DP, 140 A, 447, 459, 503, 505, 506; 417/282, 289, 279

[56] References Cited

U.S. PATENT DOCUMENTS

| | | | |
|---|---|---|---|
| 1,267,460 | 5/1918 | Salfeld | 123/139 AF |
| 1,974,851 | 9/1934 | Hurst | 123/139 AF |
| 3,614,944 | 10/1971 | Ulbing | 123/139 AF |
| 3,667,438 | 6/1972 | Moulin et al. | 123/447 |
| 3,699,939 | 10/1972 | Eckert et al. | 123/506 |
| 4,069,799 | 1/1978 | Krainski et al. | 123/139 BD |
| 4,073,275 | 2/1978 | Hofer et al. | 123/139 AF |

*Primary Examiner*—Charles J. Myhre
*Assistant Examiner*—Andrew M. Dolinar
*Attorney, Agent, or Firm*—Edwin E. Greigg

[57] ABSTRACT

A fuel injection pump for an internal combustion engine including a low pressure sump and a sump piston, reciprocating in a cylinder, for imparting elevated pressure to the fuel for delivery to injection valves. The pressure chamber in the pump cylinder can be opened to the sump at some adjustable point of the piston stroke to limit fuel delivery. A secondary conduit between the pressure chamber and the sump includes a flow throttle that variably restricts the return flow of fuel as adjusted by fluid pressure which is regulated by a secondary fuel control mechanism. This mechanism is subject to closed-loop control via an air flow rate meter disposed in the induction tube and also acts as a limiting stop for the baffle plate of the air flow rate meter.

17 Claims, 3 Drawing Figures

FIG. 2
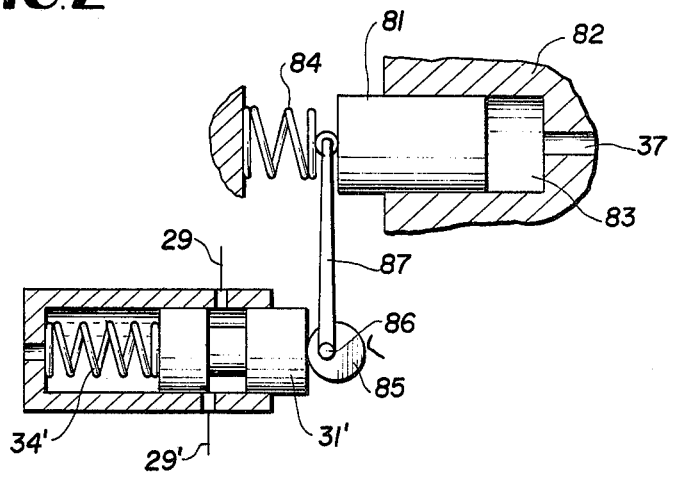
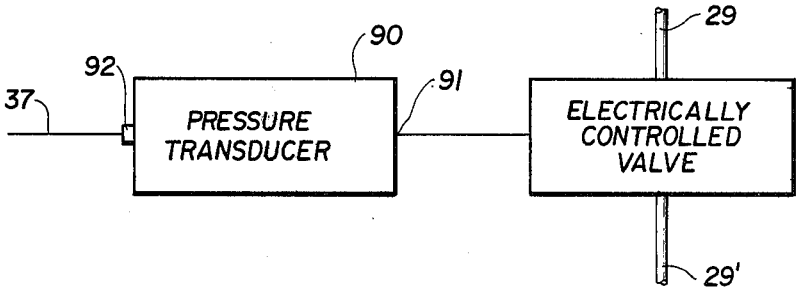
FIG. 3

FUEL INJECTION PUMP

BACKGROUND OF THE INVENTION

The invention relates to fuel injection pumps for internal combustion engines. More particularly, the invention relates to a fuel injection pump in which a piston supplies fuel under pressure to the several combustion chambers of the engine. The fuel injection pump includes a movable member which determines the amount of fuel delivered to the engine and the pump includes a sump or low pressure chamber which is coupled to the high pressure or working chamber via a throttled conduit. In a known fuel injection pump of this type, the suction channel leading from the sump to the pressure chamber has a variable throttle whose active cross section determines the amount of fuel which is aspirated by the engine during the suction stroke of the piston and which thus is finally injected. A storage chamber of constant or variable volume is coupled to the pressure chamber via a second variable throttle. However, in this known fuel injection pump, the first variable throttle in the suction channel substantially alone determines the amount of injected fuel, whereas the second throttle in the passage between the pressure chamber and the storage chamber permits only small amounts of fuel to be drained during the delivery stroke of the piston. Therefore, the injected quantity as controlled by a regulator can be adapted to only a number of selected operational states of the engine to which the injection pump is fitted. Furthermore, the change of the effective throttle cross section of the second throttle in this known pump is invariably related to load conditions and engine speed.

OBJECTS AND SUMMARY OF THE INVENTION

It is a principal object of the present invention to describe a fuel injection pump in which the period of time during which fuel is delivered remains substantially constant while varying quantities of fuel are continuously passed through an appropriately controlled throttling cross section in the line connecting the working or pressure chamber of the pump with a fuel storage volume. Accordingly, and in contrast to the prior art, the pump according to the present invention will exhibit a desirable maximum injection time under all conditions. This is especially favorable when the amounts of fuel to be injected are relatively small because it still permits adequate fuel preparation and results in soft and noise-free combustion. A secondary object of the invention is to describe a fuel injection pump in which so-called post-injection spraying or dribbling is prevented as the latter tends to produce a high concentration of hydrocarbons in the exhaust gas.

These and other objects are attained according to the invention by providing a final control element which in the prior art defines the amount of fuel delivered, but in this case occupies a substantially constant position defining primarily the duration of fuel delivery, whereas a throttle connected to the pressure chamber of the pump and permitting outflow of fuel therefrom may be adjusted so as to determine the amount of fuel delivered to the engine. It is a particular feature of the invention that it may be used in a closed control loop wherein the amount of fuel injected to the engine is the actual measured value and wherein a comparator mechanism compares this actual value with a reference value and adjusts the throttle to initiate a correspondence of these two values.

The invention will be better understood as well as further objects and advantages thereof become more apparent from the ensuing detailed description of a preferred exemplary embodiment taken in conjunction with the drawing.

BRIEF DESCRIPTION OF THE DRAWING

FIG. 2 is a schematic diagram of another embodiment of the invention which includes a cam operated throttle valve.

FIG. 3 is a block diagram of a third embodiment of the invention.

DESCRIPTION OF THE PREFERRED EMBODIMENT

Figure 1:
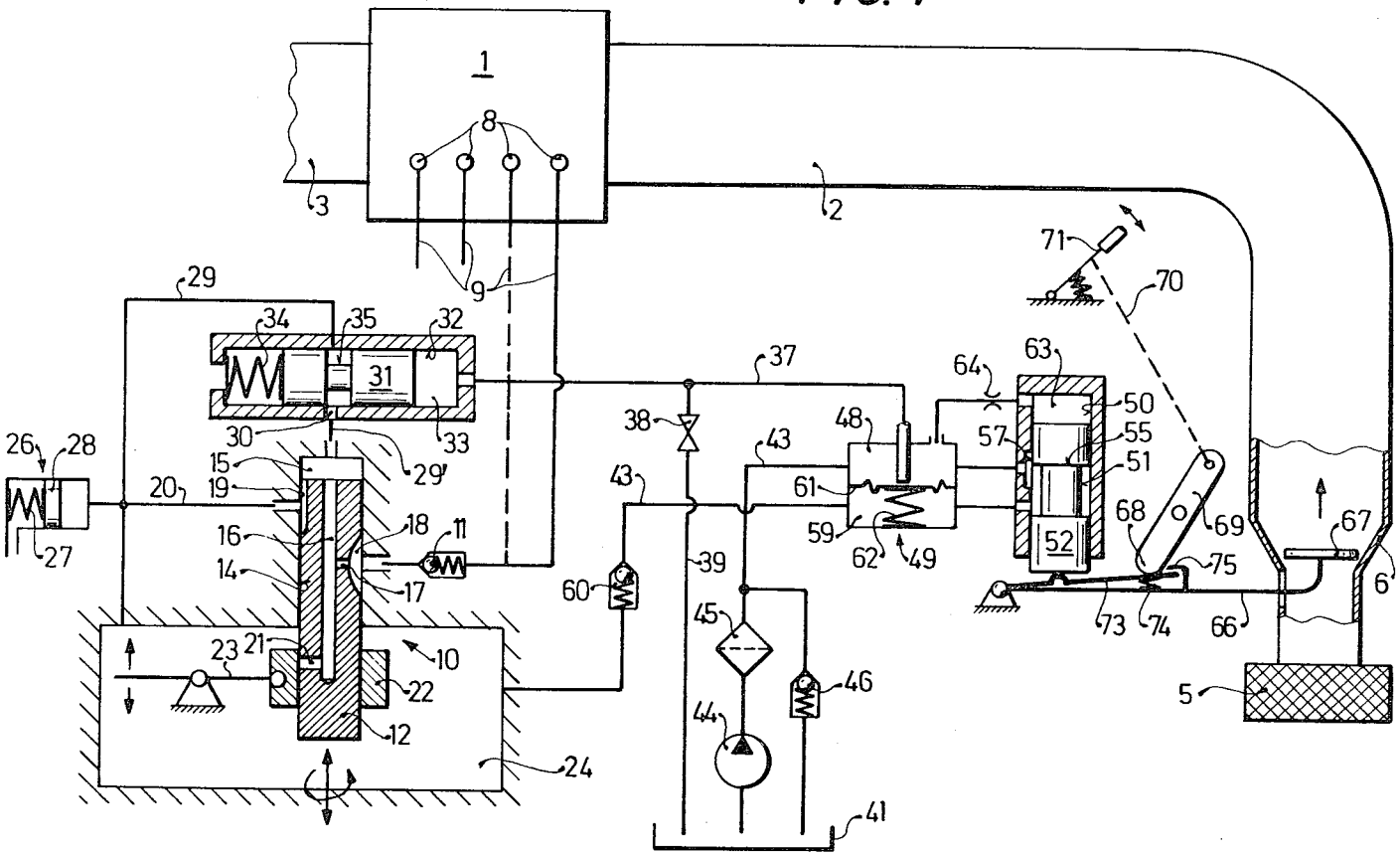
FIG. 1 is a schematic diagram of portions of an internal combustion engine illustrating a preferred exemplary embodiment of the invention.

Turning now to the drawing, there will be seen illustrated in simplified manner an internal combustion engine 1 with an induction tube 2 and an exhaust gas manifold 3. The inlet to the induction tube 2 is equipped with an air filter 5 adjacent to which the induction tube is enlarged in the manner of a funnel 6. The engine includes known injection valves 8 and fuel conduits 9 leading thereto from an injection pump 10. Each of the individual injection lines 9 includes a check valve 11 which opens in the direction of the injection nozzles. The fuel injection pump is shown as an example as a distributor pump including a pump piston which is reciprocated and rotated at the same time by drive means which are not shown. The pump piston 12 and the cylinder 14 in which it moves defines a pressure chamber or working chamber 15 which communicates through a channel 16 in the piston and a branching radial bore 17 with an adjacent longitudinal distributor groove 18. During the delivery stroke of the pump piston the longitudinal groove 18 permits fuel to flow from the cylinder 14 to the various injection lines 9 in sequence. The number of injection lines 9 is equal to the number of cylinders of the engine and their termini are distributed uniformly around the periphery of the cylinder 14 so that they sequentially communicate with the longitudinal distribution groove during the rotation of the pump piston.

When the pump executes a downward suction stroke, the pressure chamber of the pump is supplied with fuel via a peripheral longitudinal groove 19 and a bore 20 extending within the housing of the pump. The longitudinal channel 16, which is a blind bore, is connected to a radial relief channel, the opening of which on the outside surface of the piston is variably closeable by an annular slide 22. The position of the annular slide 22 is defined by a lever 23 which may occupy a substantially constant position but may also be pivoted in dependence on various operational engine variables. The position of the annular slide may be such that the relief channel 21 is closed during the entire delivery stroke of the pump piston. However, if the annular slide is pushed to a lower position in the diagram, the relief channel 21 will be opened at some point during the delivery stroke, thereby immediately relieving the work chamber 15 of pressure and thus terminating the delivery of fuel into the injection lines 9. The unused fuel then flows through the channel 21 into a sump 24. During the suction stroke of the piston, fuel is supplied from the sump 24 via a supply conduit 20 to the pressure chamber of the pump. Further coupled to the sump is a storage volume 26 which includes a piston 28 loaded by a spring 27. The sump 24 is further coupled via the line 29' with the pressure chamber 15 in a manner that cannot be disturbed by the position of the pump piston.

The flow through the line 29 is controlled, however, by a throttle element 31 in the form of a spool valve which moves within a cylinder 32 and defines a pressure chamber 33. The opposite face of the spool valve 31 is loaded by a spring 34. An annular groove 35 in the spool valve 31 defines the flow through the conduit 29' in dependence on the axial position of the spool valve. The position occupied by the spool valve is determined by the pressure in the chamber 33 which communicates through a line 37 that is connected via a throttle 38 to the fuel tank 41. The position of the throttle element 31 is not affected by pressure of the fuel flowing within the annular groove 35 of the throttle element 31. As seen in FIG. 1, the radially-extending sides of the annular groove 35 are of equal area. Thus, the force exerted by the pressure of the fuel on one side of the annular groove 35 tending to move the throttle element 31 in one direction within the cylinder 32 is opposed by an equal force exerted by the pressure of the fuel on the other side of the annular groove 35 tending to move the throttle element 31 in an opposite direction within the cylinder 32. The primary supply of fuel takes place from the fuel tank 41 by means of a fuel pump 44 which delivers fuel under relatively low pressure through an optional filter 45 into a fuel supply line 43. A pressure control valve 46 may be installed to maintain a substantially constant primary fuel pressure in the line 43. The primary fuel pressure may also be altered in dependence on operational or external variables, for example air pressure or temperature.

The fuel line 43 terminates in the valve chamber of a differential pressure valve 49. Connected to the chamber 48 is the guide bore 50 of a second valve spool 52 having an annular control groove 51 and serving to regulate the amount of fuel passing through the fuel supply line 43. Depending on the axial position of the spool valve 52, an edge 55 thereof defines together with an opening 57 a variable flow cross section for fuel flow through the line 43. Downstream of the variable orifice 55/57, the fuel supply line branches off from the volume defined by the annular groove 51 in a manner that cannot be closed off by the spool valve 52 and leads through the uncontrolled chamber 59 of the differential pressure valve 49 to the suction side of the injection pump via a check valve 60 opening in the direction of the sump.

The valve chamber 48 of the differential pressure valve 49 is separated from the second chamber 59 by a diaphragm 61 loaded by a spring 62. The characteristics of the spring 62 and its tension determine the differential pressure which the valve 49 provides across the metering orifice 55/57. The diaphragm 61 cooperates with a perpendicular extension of the line 37 in the manner of a flat seat valve through which fuel may flow to the chamber 33 or via the throttle 38 and the line 39 to the fuel reservoir 41. The pressure chamber 63 defined by the second valve spool 52 and its guide bore 50 communicates via a fixed throttle 64 with the fuel supply line upstream of the flow orifice 57. Accordingly, the pressure actuating the second valve spool 52 is the regulated and substantially constant fuel pressure which prevails on the delivery side of the pump 44. This primary fuel pressure causes the valve spool 52 to exert a force on a pivotal arm 66, one end of which is mounted in a friction-reducing bearing and the other end of which is equipped with a baffle plate 67 that moves within the induction tube portion 6. The air flowing into the induction tube causes a displacement of the baffle plate 67 and an opposition to the substantially constant force exerted by the fuel pressure and the spool valve 52.

The induction tube portion 6 is shaped like a funnel in such a way that equal amounts of increase of the annular aperture defined between the baffle plate 67 and the wall of the induction tube require different displacements of the baffle plate 67 depending on its position while the pressure difference across the baffle plate remains constant. However, a displacement of the baffle plate 67 also changes the size of the metering orifice 55/57. By making the orifice 57 a slit for example, its free opening is a linear function of the displacement of the spool valve 52 so that a fixed ratio of air to fuel may be maintained over the variable load domain of the engine.

The maximum displacement of the baffle plate 67 is defined by a variable stop 68 located in the pivotal domain of the arm 66. In the example shown, this stop is indicated schematically as a centrally mounted lever 69, the other end of which is coupled via linkage 70 to a spring loaded gas or accelerator pedal 71.

The mechanism described above functions as follows: When the engine operates in the steady state and the stop 68 occupies a particular position at which the pivotal arm 66 has come to rest, the edge 55 of the spool valve 52 defines a particular portion of the flow cross section 57 through which an appropriate amount of fuel flows under the influence of the constant differential pressure. At intermediate positions of the baffle plate, i.e. when it is not in contact with the stop 68, the fuel metering cross section 57 is opened to varying degrees depending on the displacement of the baffle plate and the air flow cross section defined between it and the air funnel 6. If the pressure drop across the baffle plate is constant, the annular flow path is proportional to the air flow rate. Thus, the mass of fuel and the mass of air delivered to the engine is in a particular ratio in order to provide an optimum composition of the exhaust gases.

Furthermore, when the engine is operating at constant speed and load, the differential pressure valve 49 will have regulated a constant differential pressure across the metering flow orifice 57 so that a definite quantity of fuel flows off via the return line 39. Under these stationary conditions, the amount of fuel delivered through the fuel supply 43 is exactly equal to the amount of fuel delivered to the injection lines 9. This quantity of fuel is substantially determined by the position of the spool valve 31, i.e. the free flow cross section 30 within the line 29', inasmuch as the annular control slide 22 assumes a substantially constant position which only defines the maximum amount of fuel.

The fuel flowing back to the reservoir via the line 29 during the delivery stroke is delivered to the storage chamber 26 and will thus be available to the pump piston 12 when it descends during the suction stroke. The same is true for the fuel flowing through the relief channel 21 at the end of the effective delivery stroke. The position of the spool valve 31 is determined by the pressure in its chamber 33 which is equal to the pressure at the return flow throttle 38, which in turn depends on the amount of fuel released by the differential pressure valve 49.

If, beginning with the stationary conditions, the lever 69 is moved from a position of low-load, i.e. minimum fuel, to a position of relatively greater load, the metering cross section 57 increases. If the amount of fuel injected is assumed to remain temporarily constant, the pressure in the uncontrolled chamber 59 of the differential pressure valve 49 will increase. Accordingly, the diaphragm 61 will be displaced and the opening in the line 37 will be diminished, permitting less fuel to flow to the throttle 38 so that the pressure prevailing there will be decreased. The same decreased pressure acting on the spool valve 31 will permit an axial displacement of the same in the sense of diminishing the opening 30 in the line 29' until an equilibrium of forces is reestablished on the spool valve 31.

Accordingly, during the delivery stroke of the pump piston 12, a reduced amount of fuel is able to flow back to the suction side of the injection pump so that the amount of fuel delivered to the injection lines 9 during the delivery stroke is effectively increased.

Conversely if, beginning with a stationary state of the engine, the adjustable stop 68 is moved in the sense of diminishing the fuel quantity, the entire process will take place in reverse fashion. Stated another way, the spool valve 52 is a fuel metering device for metering the actual fuel quantity injected by the injection pump 10. The variable orifice 55/57 of the spool valve 52, which is controlled by either the lever 69 or the baffle plate 67, determines a reference fuel quantity which is intended to be injected by the injection pump 10. This reference fuel quantity is that fuel quantity which, when flowing through the spool valve 52, produces a pressure drop across the spool valve 52 which is equal to the constant differential pressure determined by the spring 62. The differential pressure valve 49 functions as a comparator device for comparing the actual pressure drop across the spool valve 52 corresponding to the actual fuel quantity flowing through the spool valve 52 with the constant differential pressure determined by the spring 62 corresponding to the reference fuel quantity intended to flow therethrough. As a result of this comparison, the position of the throttle element 31 is adjusted to minimize the difference between the actual fuel quantity flowing through the spool valve 52 and the reference fuel quantity intended to flow therethrough. In order to permit the movability of the lever 68 with very light forces, there may be provided an intermediate lever 73 acting between the spool valve 52 and the lever 69 and a common bearing point. A spring 74 may be compressed between the intermediate lever 73 and the pivotal arm 66, tending to move the intermediate lever against a stop 75 which limits its maximum motion.

When so constructed, the lever 69 may be used to reduce the engine load. The pivotal arm 66 remains in its initial position while the spool valve has begun to follow the position of the intermediate lever 73 and has caused a reduction in the metering cross section 57 while the spring 74 is compressed. When the engine speed decreases, the baffle plate 67 finally follows the initial motion of the intermediate lever 73.

The apparatus described above serves to meter out fuel for injection on the basis of the position of substantially only the lever 69 unless it does not limit the position of the baffle plate in which case it is the position of the baffle plate that determines the fuel metering cross section. By appropriate shaping of the funnel 6 and the metering cross section 57, it is possible to adapt the amount of injected fuel for a particular air flow rate in accordance with any operational domain of the engine. Engine variables may be used to adjust the fuel-air ratio in a compensatory manner, by engaging the pressure control valve 46, by adjusting the tension of the pressure spring 62 in the valve 49, or that of the spring 34. A further corrective step can be taken by adjusting the position of the annular slide 22. For such a purpose, the lever 23 is coupled to a regulator for providing engine shut-off or starting fuel excess.

It is a substantial advantage of the operation of the fuel injection pump according to the present invention that the fuel delivery stroke executed by the pump piston is constant and yet the time taken for fuel injection is relatively long even when very small amounts of fuel are injected. This fact results in a substantial reduction of the combustion noise in Diesel engines, especially for partially loaded operation.

However, the invention is not limited to the embodiment shown in the exemplary illustration. For example, instead of the distributor injection pump shown here, it is possible to use any fuel injection pump in which a final control element determines by its position the amount of fuel delivered by a pump piston. In particular, it is possible to use the invention in a suction throttle pump with controlled stroke or in injection pumps where the pump piston has an oblique control edge cooperating with a relief channel, as, for example, disclosed in U.S. Pat. No. 3,906,916, issued Sept. 23, 1975, to Helmut Laufer. In such a case, the final control element might be a control rod which rotates the pump piston. The throttle mechanism in the line 29 of the present exemplary embodiment may be replaced by a suitable rotating valve. The throttle element may also be displaced via cams or linkage by a mechanical or electrical controller in dependence on engine speed and engine load. Furthermore, the annular control slide 22 may also be shifted in order to change the fuel quantity or fuel delivery time, for example in dependence on engine variables related to exhaust gas composition.

In the embodiment shown in FIG. 2, an adjustment piston 81 of known type moves within a cylinder 82. The piston 81 has one face which defines, with the cylinder 82, a pressure chamber 83, and an opposite face which is loaded by a spring 84. The position of the piston 81 within the cylinder 82 is determined by the pressure within the chamber 83, which is connected to the fuel line 37. A cam 85, pivotable about a fixed pivot pin 86, is affixed to a connecting link 87 which is pivotally connected to the piston 81, so that the angular position of the cam 85 is determined by the position of the piston 81. A throttle element 31', which is connected in the line 29 and which is similiar to, and serves the same function as, the throttle element 31 described above, has one face held in contact with the cam 85 by a spring 34', so that the position of the throttle valve 31' is determined by the angular position of the cam 85.

In the embodiment of the invention shown in FIG. 3, an electrical servo-mechanism controls the flow of fuel through the line 29 in accordance with the pressure in the line 37. The servomechanism includes a pressure transducer 90 for supplying at its output 91 an electrical signal proportional to a pressure sensed at its input 92, and an electrically controlled throttle valve, disposed in the line 29 to function as the throttle element 31, whose position is determined by an electrical signal supplied to the valve. The input 92 of the pressure transducer 90 is connected to sense the pressure in the line 37, and the output 91 of the pressure transducer 90 is connected to supply the electrical control signal to the valve, whereby the position of the valve is determined by the pressure in the line 37.

The foregoing relates to a preferred exemplary embodiment of the invention, it being understood that other embodiments and variants thereof are possible within the spirit and scope of the invention.

What is claimed and desired to be secured by Letters Patent of the United States is:

1. A fuel injection pump for an internal combustion engine which comprises:

a fuel sump;

a pump cylinder;

a steplessly variable throttle means connecting said pump cylinder to said fuel sump, for controlling the flow of fuel from said pump cylinder to said fuel sump;

pump intake means for admitting fuel into said pump cylinder from said fuel sump;

pump outlet means for admitting fuel into said internal combustion engine from said pump cylinder;

a piston movably disposed in said pump cylinder for drawing fuel from said sump into said cylinder through said pump intake means and for expelling the fuel from said cylinder under pressure through said pump outlet means and said variable throttle means, wherein said variable throttle means connects said pump cylinder to said fuel sump in a manner that cannot be disturbed by operation of said piston; and a relief valve for pressure-relieving said cylinder at a variable point of the stroke of said piston, said relief valve determining the length of the piston stroke during which fuel may be supplied to the engine, and thereby determining a maximum fuel quantity supplied to the engine when said variable throttle means is completely closed; and adjustment means connected to said variable throttle means for continuous, uninterrupted adjustment of said variable throttle means during operation of the engine, said adjustment means determining the fuel quantity supplied to the engine independently of the relief valve, up to said maximum fuel quantity.

2. A fuel injection pump as defined by claim 1, wherein said pump cylinder has a relief orifice and said relief valve variably opens said orifice to establish communication between said pump cylinder and said fuel sump.

3. A fuel injection pump as defined by claim 2, wherein said relief valve is a sliding ring surrounding said pump cylinder, one edge of said ring serving to define an effective relief orifice in the wall of said pump cylinder.

4. A fuel injection pump as defined by claim 2, wherein said relief valve includes an oblique portion of said piston and further includes means for rotating said piston to cause said oblique portion thereof to define an effective relief orifice in the wall of said pump cylinder.

5. A fuel injection pump as defined by claim 1, further comprising a fuel storage chamber connected to said pump cylinder and to said sump.

6. A fuel injection pump as defined by claim 5, wherein said fuel storage chamber has variable volume.

7. A fuel injection pump as defined by claim 1, wherein said adjustment means comprises a cam.

8. A fuel injection pump as defined by claim 1, wherein said adjustment means is an electrical servomechanism.

9. A fuel injection pump for an internal combustion engine which comprises:

a fuel sump;

a pump cylinder;

a steplessly variable throttle means connecting said pump cylinder to said fuel sump, for controlling the flow of fuel from said pump cylinder to said fuel sump;

pump intake means for admitting fuel into said pump cylinder from said fuel sump;

pump outlet means for admitting fuel into said internal combustion engine from said pump cylinder;

a piston movably disposed in said pump cylinder for drawing fuel from said sump into said cylinder through said pump intake means and for expelling the fuel from said cylinder under pressure through said pump outlet means and said variable throttle means, therein said variable throttle means connects said pump cylinder to said fuel sump in a manner that cannot be disturbed by operation of said piston;

a relief valve for pressure-relieving said cylinder at a variable point of the stroke of said piston;

adjustment means connected to said variable throttle means for continuous, uninterrupted adjustment of said variable throttle means during operation of the engine;

a metering device for metering the actual fuel quantity injected by the fuel injection pump; and a comparator device for comparing the actual fuel quantity injected by the fuel injection pump with a reference value and coupled to said adjustment means so that said variable throttle means is adjusted by said adjustment means depending on the results of the comparison, whereby the difference between the actual fuel quantity injected by the fuel injection pump and the reference value is minimized.

10. A fuel injection pump for an internal combustion engine which comprises:

a fuel sump;

a pump cylinder;

a steplessly variable throttle means connecting said pump cylinder to said fuel sump, for controlling the flow of fuel from said pump cylinder to said fuel sump;

pump intake means for admitting fuel into said pump cylinder from said fuel sump;

pump outlet means for admitting fuel into said internal combustion engine from said pump cylinder;

a piston movably disposed in said pump cylinder for drawing fuel from said sump into said cylinder through said pump intake means and for expelling the fuel from said cylinder under pressure through said pump outlet means and said variable throttle means, therein said variable throttle means connects said pump cylinder to said fuel sump in a manner that cannot be disturbed by operation of said piston;

a relief valve for pressure-relieving said cylinder at a variable point of the stroke of said piston;

adjustment means connected to said variable throttle means for continuous, uninterrupted adjustment of said variable throttle means during operation of the engine;

a fuel reservoir in fluid communication with an inlet of said fuel sump;

flow control means connected upstream of said inlet of said fuel sump and defining a variable metering orifice which determines a reference fuel quantity intended to flow to the sump of the fuel injection pump;

comparator means, coupled to said adjustment means, for comparing the actual fuel quantity flowing to the sump of said fuel injection pump with said reference fuel quantity whereby said variable throttle means is adjusted by said adjustment means depending on the results of the comparison to minimize the difference between the actual fuel quantity flowing to the sump of the fuel injection pump and said reference fuel quantity; and air flow responsive means, coupled to said flow control means to vary the flow therethrough.

11. A fuel injection pump as defined by claim 10, wherein said reference fuel quantity corresponds to a predetermined pressure drop across said flow control means and said actual fuel quantity flowing to the sump of said fuel injection pump corresponds to the actual pressure drop across said flow control means.

12. A fuel injection pump as defined by claim 10, wherein said comparator means is a differential pressure valve connected across said flow control means, said differential pressure valve having a valve chamber and a valveless chamber, said valveless chamber being connected downstream of said flow control means and said valve chamber being connected upstream of said flow control means, a diaphragm separating said valve chamber and said valveless chamber, spring means in said valveless chamber for loading said diaphragm, and valve means in said valve chamber, closable by said diaphragm, a fuel return line, a fuel reservoir and a flow restrictor, said fuel return line connecting said valve means to said fuel reservoir via said flow restrictor, the upstream side of said flow restrictor being connected to said adjustment means for said variable throttle means.

13. A fuel injection pump as defined by claim 12, wherein said variable throttle means is a spool valve which variably restricts the communication between said pump cylinder and said sump.

14. A fuel injection pump as defined by claim 13, further comprising a check valve disposed between said comparator means and said fuel sump.

15. A fuel injection pump as defined by claim 14, wherein said flow control means includes a second spool valve subjected to a constant return force and said air flow responsive means includes lever means, extending into an induction manifold of said internal combustion engine and having a baffle plate which is movable by the air flow therethrough and so disposed as to displace said second spool valve, thereby adjusting the flow through said flow control means.

16. A fuel injection pump as defined by claim 15, further comprising adjustable stop means for limiting the maximum displacement of said baffle plate and said lever means.

17. A fuel injection pump as defined by claim 1, further comprising means for adjusting said relief valve in dependence on engine variables.

* * * * *